US007559208B2

(12) United States Patent
Ota et al.

(10) Patent No.: US 7,559,208 B2
(45) Date of Patent: Jul. 14, 2009

(54) DISPLACEMENT CONTROL MECHANISM FOR VARIABLE DISPLACEMENT COMPRESSOR

(75) Inventors: Masaki Ota, Kariya (JP); Satoshi Umemura, Kariya (JP); Masahiro Kawaguchi, Kariya (JP); Sokichi Hibino, Kariya (JP)

(73) Assignees: Kabushiki Kaisha Toyota Jidoshokki, Kariya-shi (JP); Daimler AG, Stuttgart (DE)

( * ) Notice: Subject to any disclaimer, the term of this patent is extended or adjusted under 35 U.S.C. 154(b) by 631 days.

(21) Appl. No.: 11/243,266

(22) Filed: Oct. 3, 2005

(65) Prior Publication Data

US 2006/0080983 A1 Apr. 20, 2006

(30) Foreign Application Priority Data

Oct. 4, 2004 (JP) ..... 2004-291723

(51) Int. Cl.
*F04B 1/29* (2006.01)

(52) U.S. Cl. ..... 62/228.3; 417/222.2

(58) Field of Classification Search ..... 62/228.3; 417/279, 222.2

See application file for complete search history.

(56) References Cited

U.S. PATENT DOCUMENTS 3,918,254 A * 11/1975 Wernberg ..... 60/39.281
4,073,603 A * 2/1978 Abendschein et al. .... 417/222.2
6,371,734 B1 4/2002 Ota et al. ..... 417/222.2
2004/0055456 A1 * 3/2004 Kurita et al. ..... 92/12.2

FOREIGN PATENT DOCUMENTS

| | | |
|---|---|---|
| JP | 8-021365 | 1/1996 |
| JP | 10-169552 | 6/1998 |
| JP | 2002-168173 | 6/2002 |
| JP | 2004-108245 | 4/2004 |

* cited by examiner

*Primary Examiner*—William E Tapolcai
(74) *Attorney, Agent, or Firm*—Locke Lord Bissell & Liddell LLP

(57) ABSTRACT

A displacement control mechanism for a variable displacement compressor includes a first valve hole, a first valve body, a pressure sensing means operable to sense pressures of first and second points in a discharge pressure region to adjust a position of the first valve body, and a pressure-difference-increasing means operable to increase pressure difference between the first and second points when the pressure of a suction pressure region falls below a predetermined standard pressure. The pressure sensing means displaces the first valve body to increase an opening degree of the first valve hole according to increase of the pressure difference when the first valve hole is part of a supply passage. The pressure sensing means displaces the first valve body to decrease the opening degree of the first valve hole according to the increase of the pressure difference when the first valve hole is part of a bleed passage.

10 Claims, 4 Drawing Sheets

DISPLACEMENT CONTROL MECHANISM FOR VARIABLE DISPLACEMENT COMPRESSOR

BACKGROUND OF THE INVENTION

The present invention relates to a displacement control valve used for a variable displacement compressor that adjusts the pressure in a pressure control chamber by introducing a refrigerant in the discharge pressure region of the compressor into the pressure control chamber through a supply passage and releasing the refrigerant in the pressure control chamber to the suction pressure region of the compressor through a bleed passage, thereby controlling displacement of the compressor.

In a variable displacement compressor having a pressure control chamber that accommodates a swash plate whose inclination angle is variable, the inclination angle of the swash plate decreases as the pressure in the pressure control chamber rises. This decrease of the inclination angle increases the stroke of a piston, thereby to increase the displacement of the compressor. On the other hand, the inclination angle of the swash plate increases as the pressure in the pressure control chamber falls. This increase of the inclination angle decreases the stroke of the piston, thereby to decrease the displacement of the compressor.

Unexamined Japanese Patent Publication No. 2001-153044 discloses a displacement control valve operable to open and close a supply passage for introducing a refrigerant gas from a discharge pressure region into a crank chamber (pressure control chamber). The displacement control valve includes a solenoid and a pressure sensing means operable to sense a pressure difference between two points at the discharge pressure region to operate a valve body. As the flow rate of the refrigerant gas increases, the pressure difference between the two points increases. According to the increase of the pressure difference, the pressure sensing means displaces the valve body in the direction which causes a valve hole to be opened. Thus, the pressure in the crank chamber rises, and the displacement of the compressor is decreased. On the other hand, as the flow rate of the refrigerant gas decreases, the pressure difference between the two points decreases. According to the decrease of the pressure difference, the pressure sensing means displaces the valve body in the direction which causes the valve hole to be closed. Thus, the pressure in the crank chamber falls, and the displacement of the compressor is increased.

The displacement control valve includes the solenoid that generates an electromagnetic forces acting on the valve body against the above pressure difference. The displacement control valve varies the opening degree of the valve hole in accordance with the variation of the value of an electric current (a duty ratio) supplied to the solenoid. The value of the electric current (the duty ratio) supplied to the solenoid is determined by a controller. For example, the controller determines the value of the electric current (the duty ratio) supplied to the solenoid based on the difference between a set target room temperature and a detected room temperature.

When the variable displacement compressor operates with insufficient refrigerant gas, the room temperature does not fall to the target room temperature because of the insufficient flow rate of the refrigerant gas. In accordance with the situation, the controller changes the value of the electric current (the duty ratio) supplied to the solenoid to the maximum so that the inclination angle of the swash plate is changed to the maximum. Even in a state where the rotation speed of a rotary shaft becomes high to increase the flow rate of the refrigerant gas, the variable displacement compressor operates at its maximum displacement. Such high rotation speed of the rotary shaft and large displacement operation produce a great load acting on the compressor, more particularly on the swash plate, which is undesirable in view of reliable operation. Additionally, the discharge pressure does not increase because of the insufficient refrigerant gas. In a variable displacement compressor including a hinge mechanism as disclosed in Unexamined Japanese Patent Publication No. 2004-108245, which allows the swash plate to freely move in the axial direction of the rotary shaft, the inertial force of the piston exceeds compressive reactive force, so that the inclination angle of the swash pate at the maximum displacement operation may exceed a predetermined maximum inclination angle. If the inclination angle of the swash plate exceeds the predetermined maximum inclination angle, the piston may collide against a plate that forms a suction valve.

Even if the refrigerant gas is sufficient in the variable displacement compressor, the operation of the variable displacement compressor at high rotation speed and at high displacement is undesirable in view of reliable operation In the variable displacement compressor including the hinge mechanism as disclosed in Unexamined Japanese Patent Publication No 2004-108245. the inclination angle of the swash plate may exceed the predetermined maximum inclination angle because of a great inertial force of the piston.

The present invention is directed to avoidance of large displacement operation of a variable displacement compressor with insufficient refrigerant gas and at high rotation speed.

SUMMARY OF THE INVENTION

According to the present invention, a displacement control mechanism is used for a variable displacement compressor, which adjusts a pressure in a pressure control chamber by introducing a refrigerant in a discharge pressure region into the pressure control chamber through a supply passage and releasing the refrigerant in the pressure control chamber to a suction pressure region through a bleed passage, thereby controlling displacement of the compressor. The displacement control mechanism includes a first valve hole, a first valve body, a pressure sensing means and a pressure-difference-increasing means. The first valve hole partially forms the supply passage or the bleed passage. The first valve body is operable to open and close the first valve hole. The pressure sensing means operable to sense a pressure of a first point in the discharge pressure region and a pressure of a second point in the discharge pressure region and to adjust a position of the first valve body based on pressure difference between the first and second points. The pressure-difference-increasing means is operable to increase the pressure difference between the first and second points when the pressure of the suction pressure region falls below a predetermined standard pressure. The pressure sensing means displaces the first valve body in such a direction so as to increase an opening degree of the first valve hole according to increase of the pressure difference when the first valve hole is a part of the supply passage. The pressure sensing means displaces the first valve body in such a direction so as to decrease the opening degree of the first valve hole according to the increase of the pressure difference when the first valve hole is a part of the bleed passage.

BRIEF DESCRIPTION OF THE DRAWINGS

The features of the present invention that are believed to be novel are set forth with particularity in the appended claims. The invention together with objects and advantages thereof, may best be understood by reference to the following description of the presently preferred embodiments together with the accompanying drawings in which:

DETAILED DESCRIPTION OF THE PREFERRED EMBODIMENTS

Figures 1A, 1B:
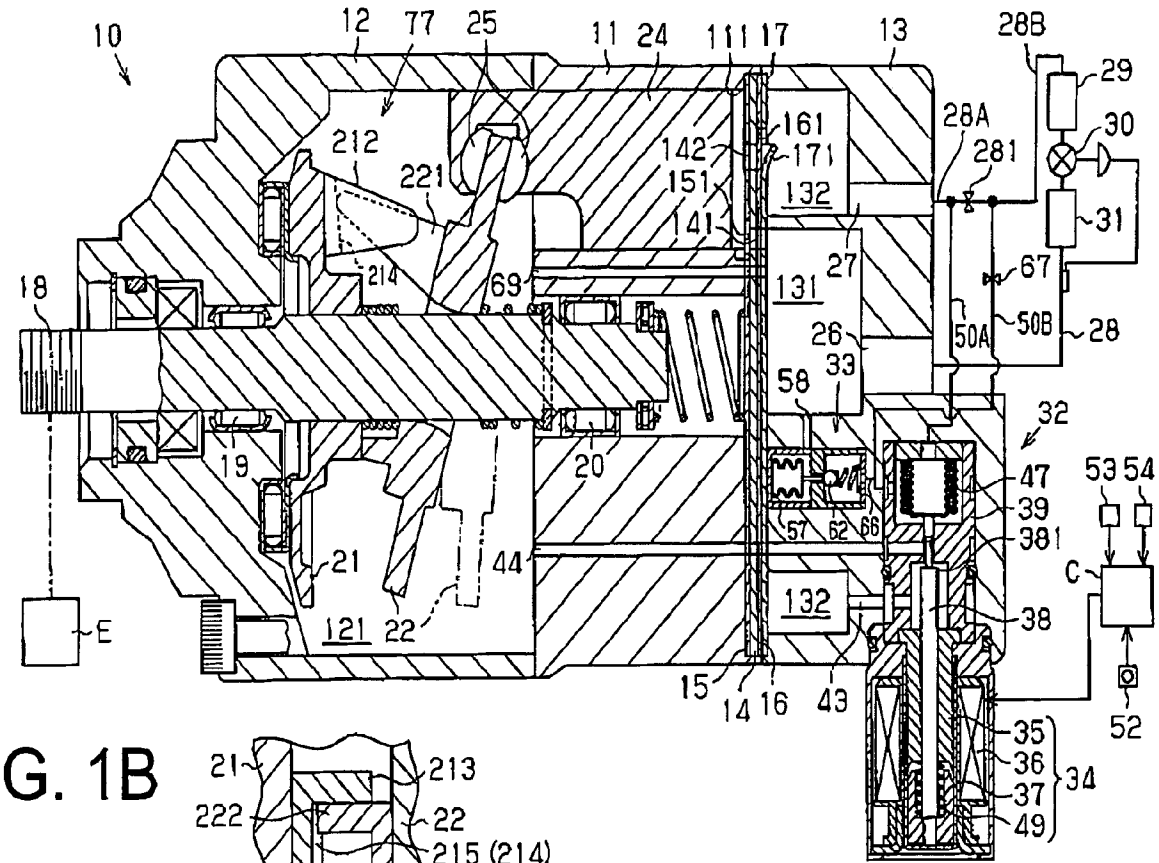
FIG. 1A is a longitudinal cross-sectional view of a variable displacement compressor of a first preferred embodiment according to the present invention.
FIG. 1B is a cross-sectional view of a hinge mechanism of the variable displacement compressor of the first preferred embodiment.
Figure 2:
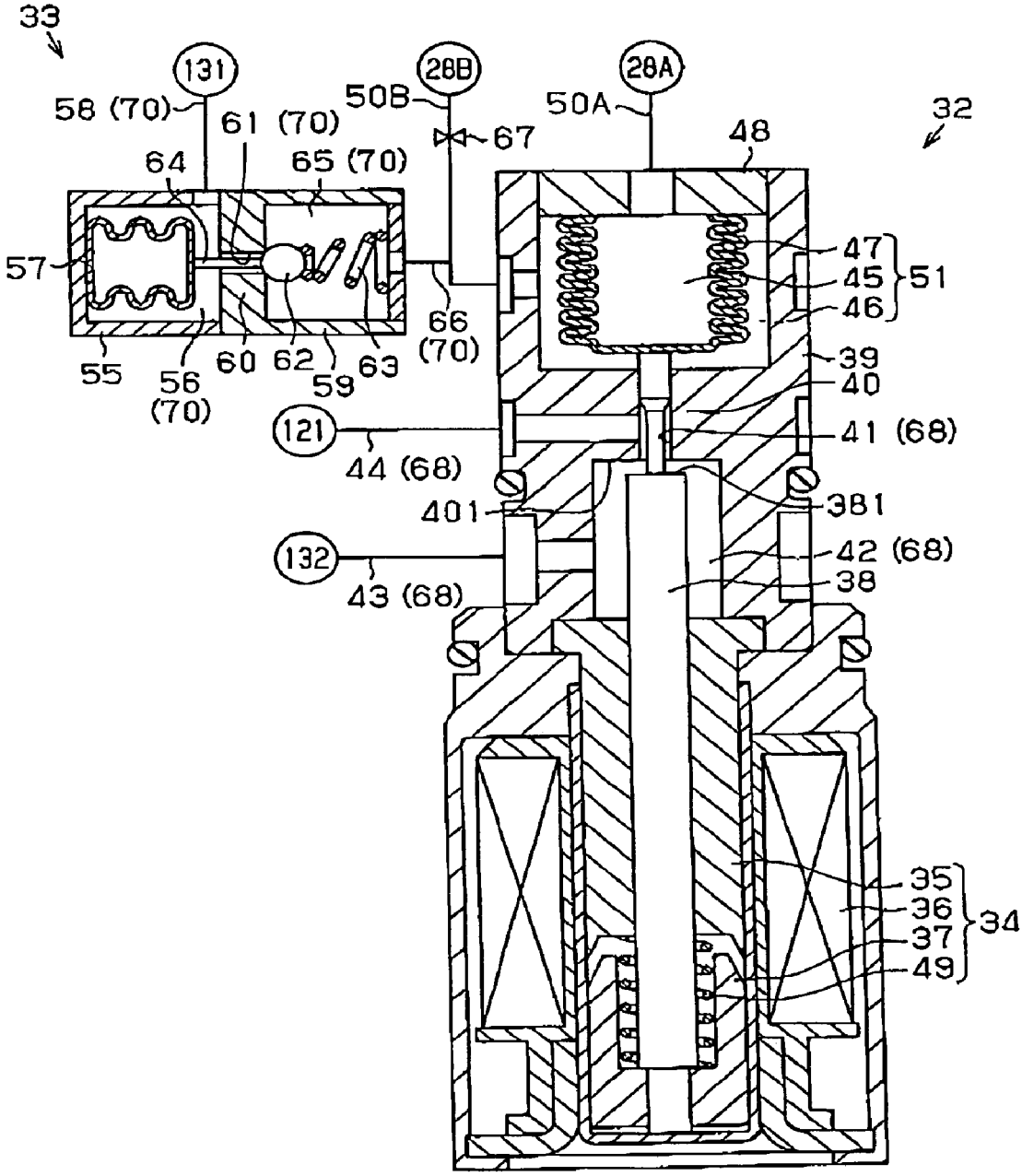
FIG. 2 is a cross-sectional view of a pressure reducing valve and a displacement control valve of the first preferred embodiment.

The following will describe a first preferred embodiment according to the present invention with reference to FIGS. 1A through 2. As shown in FIG. 1A, a variable displacement compressor 10 has a housing assembly including a cylinder block 11, a front housing 12 and a rear housing 13. The front housing 12 is connected to the front end (the left end as seen in FIG. 1) of the cylinder block 11. The rear housing 13 is connected to the rear end (the right end as seen in FIG. 1) of the cylinder block 11 through a valve plate 14, valve plate forming plates 15 and 16 and a retainer forming plate 17.

The front housing 12 and the cylinder block 11 cooperate to define a pressure control chamber 121 through which a rotary shaft 18 extends. The rotary shaft 18 is supported by the front housing 12 and the cylinder block 11 via radial bearings 19 and 20. The rotary shaft 18 projects from the pressure control chamber 121 to the outside of the compressor 10 and is driven to rotate by a vehicle engine E as an external drive source via an electromagnetic clutch (not shown).

A lug plate 21 is secured to the rotary shaft 18. A swash plate 22 is supported by the rotary shaft 18 in such a way that it is slidable in the axial direction of the rotary shaft 18 and inclinable relative to the axial direction. A hinge mechanism 77 is provided between the swash plate 22 and the lug plate 21 and connects the swash plate 22 to the lug plate 21 for allowing the swash plate 22 to incline relative to the lug plate 21 and transmitting the rotation of the rotary shaft 18 to the swash plate 22. As shown in FIG. 1B, the hinge mechanism 77 includes a pair of arms 212 and 213 extending from the lug plate 21 toward the swash plate 22 and a pair of projections 221 and 222 extending from the swash plate 22 toward-the lug plate 21. The projections 221 and 222 are inserted in a recess 214 that is formed between the paired arms 212 and 213 and movable in the recess 214. The bottom of the recess 214 provides a cam surface 215 on which the ends of the projections 221 and 222 are slidable. The above-described arrangement of the paired arms 212 and 213, the paired projections 221 and 222 and the cam surface 215 permits the swash plate 22 to incline relative to the axis of the rotary shaft 18 and also to rotate integrally with the rotary shaft 18. The inclination of the swash plate 22 is guided with the projections 221 and 222 sliding on the cam surface 215 and the wash plate 22 sliding on the rotary shaft 18.

As the center portion of the swash plate 22 moves toward the lug plate 21, the inclination angle of the swash plate 22 increases. The maximum inclination of the swash plate 22, which is shown by solid line in FIG. 1A, is restricted by contact of the swash plate 22 with the lug plate 21. The minimum inclination of the swash plate is shown by chain double-dashed line in FIG. 1A.

The cylinder block 11 has formed therethrough a plurality of cylinder bores 111 in which pistons 24 are received. The rotation of the swash plate 22 is converted into the reciprocating movement of the piston 24 via a pair of shoes 25.

The rear housing 13 has formed therein a suction chamber 131 as a suction pressure region and a discharge chamber 132 as a discharge pressure region. A suction port 141 is formed in the valve plate 14, the valve plate forming plate 16 and the retainer forming plate 17. A discharge port 142 is formed in the valve plate 14 and the valve forming palate 15. A suction valve 151 is formed on the valve forming plate 15, and a discharge valve 161 is formed on the valve forming plate 16. As the piston 24 moves leftward in its corresponding cylinder bore 111 as seen in FIG. 1A, a refrigerant gas is drawn from the suction chamber 131 into the cylinder bore 111 through the suction port 141 while pushing open the suction valve 161. As the piston 24 moves rightward in the cylinder bore 111 as seen in FIG. 1A, the refrigerant gas is compressed and discharged out of the cylinder bore 111 into the discharge chamber 132 through the discharge port 142 pushing open the discharge valve 161. The discharge valve 161 then comes Into contact with a retainer 171 on the retainer forming plate 17 thereby to restrict the opening degree of the discharge valve 161.

The rear housing 13 has formed therein a suction passage 26 through which the refrigerant gas before compression is introduced into the suction chamber 131. The rear housing 13 has also formed therein a discharge passage 27 through which the compressed refrigerant gas is delivered out of the discharge chamber 132. The suction passage 26 and the discharge passage 27 are connected by an external refrigerant circuit 28 in which a condenser 29 for removing heat from the refrigerant gas, an expansion valve 30 and an evaporator 31 for allowing the refrigerant to absorb the ambient heat are disposed. The expansion valve 30 is operable to regulate the flow rate of the refrigerant according to variation in the temperature of the refrigerant gas at the outlet of the evaporator 31. A throttle 281 is disposed in the external refrigerant circuit 28 between the discharge passage 27 and the condenser 29. The part of the external refrigerant circuit 28 between the discharge passage 27 and the throttle 281 is referred to as an external refrigerant circuit 28A, and the part of the external refrigerant circuit 28 between the throttle 281 and the condenser 29 is referred to as an external refrigerant circuit 28B.

An electromagnetic displacement control valve 32 and a pressure reducing valve 33 are installed in the rear housing 13. As shown in FIG. 1A, the displacement control valve 32 has a solenoid 34 that includes a fixed core 35, a coil 36, a movable core 37 and a spring 49. Supplying an electric current to the coil 34, the fixed core 35 is magnetized to attract the movable core 37 thereto. The spring 49 is disposed between the fixed core 35 and the movable core 36. The movable core 37 is urged by the spring force of the spring 49 away from the fixed core 35. The solenoid 34 is controlled by a controller C (shown in FIG. 1A) with electric current. In this preferred embodiment, the solenoid 34 is controlled by the controller C with duty ratio. A transmitting rod 38 is secured to the movable core 37.

The displacement control valve 32 has a valve housing 39 formed with a valve seat 40 The valve seat 40 has formed therein a valve hole 41 as a first valve hole. A valve chamber 42 is formed between the valve housing 39 and the fixed core 35 in the valve housing 39. The valve hole 41 communicates with the valve chamber 42 which in turn communicates with the discharge chamber 132 through a passage 43 that is formed in the rear housing 13 as shown in FIG. 1A. The valve hole 41 also communicates with the pressure control chamber 121 through a passage 44 that is formed in the valve housing 39, the rear housing 13, the retainer forming plate 17, the valve forming plate 16, the valve plate 14, the valve forming plate 15 and the cylinder block 11 as shown in FIG. 1A.

Referring to FIG. 2, the transmitting rod 38 is formed integrally with a valve body 381 as a first valve body. The valve body 381 is operable to come into contact with and move away from the seating face 401 of the valve seat 40. When the valve body 381 comes into contact with the seating face 401, the valve hole 41 is closed. When the valve body 381 moves away from the seating face 401, the valve hole 41 is opened.

A first pressure sensing chamber 45 and a second pressure sensing chamber 46 are defined in the displacement control valve 32 and divided by a 1O bellows 47 as a first displacement body. The bellows 47 has its fixed end that is connected to an end wall 48 of the valve housing 39 and the opposite movable end that is connected to the transmitting rod 38. The transmitting rod 38 is movable in conjunction with the bellows 47.

The first pressure sensing chamber 45 communicates with the external refrigerant circuit 28A upstream of the throttle 281 through a pressure introducing passage 50A, and the second pressure sensing chamber 46 communicates with the external refrigerant circuit 28B downstream of the throttle 281 through a pressure introducing passage 50B. The pressure in the external refrigerant circuit 28A upstream of the throttle 281 is introduced into the first pressure sensing chamber 45 through the pressure introducing passage 50A, and the pressure in the external refrigerant circuit 28B downstream of the throttle 281 and upstream of the condenser 29 is introduced into the second pressure sensing chamber 46 through the pressure introducing passage 50B. The pressure in the first pressure sensing chamber 45 and the pressure in the second pressure sensing chamber 46 act against each other via the bellows 47.

When there is a flow of the refrigerant gas in the external refrigerant circuits 28A and 28B, the pressure of the refrigerant gas in the external refrigerant circuit 28A upstream of the throttle 281 is larger than that in the external refrigerant circuit 28B downstream of the throttle 281 and upstream of the condenser 29. As the flow rate of refrigerant gas in the external refrigerant circuits 28A and 28B (or in the discharge pressure region) increases, the difference of pressures between the upstream and downstream of the throttle 281 increases so that the pressure difference between the first and second pressure sensing chambers 45 and 46 increases. On the other hand, as the flow rate of the refrigerant gas in the external refrigerant circuits 28A and 28B (or in the discharge pressure region) decreases, the pressure difference between the upstream and downstream of the throttle 281 decreases, so that the pressure difference between the first and second pressure sensing chambers 45 and 46 decreases. The pressure difference between the first and second pressure sensing chambers 45 and 46 produces a force urging the transmitting rod 38 in the direction from the valve hole 41 toward the chamber 42, or downward as seen in FIG. 2.

The first and second pressure sensing chambers 45 and 46 and the bellows 47 constitute a pressure sensing means 51 of the present invention for sensing the pressure difference between the external refrigerant circuit 28A upstream of the throttle 281 and the external refrigerant circuit 28B downstream of the throttle 281 and upstream of the condenser 29.

The opening and closing operation of the valve hole 41 depends on the balance among various forces such as the electromagnetic force generated by the solenoid 34, the spring force of the spring 49 and the urging force of the pressure sensing means 51.

The pressure sensing means 51 is operable to sense the pressure at a first point (or the external refrigerant circuit 28A) in the discharge pressure region (or the external refrigerant circuits 28A and 28B) and the pressure at a second point (or the external refrigerant circuit 28B) in the discharge pressure region and to adjust the position of the transmitting rod 38 or the valve body 381 based on the difference of pressures between the above first and second points.

As shown in FIG. 1A, the controller C, which controls the solenoid 34 of the displacement control valve 32 with electric current (duty ratio), supplies an electric current to the solenoid 34 while an air conditioner switch 54 is turned on. With the air conditioner switch 54 turned off, the controller C stops supplying the electric current to the solenoid 34. A room temperature setting device 53 and a room temperature detector 54 are electrically connected to the controller C. With the air conditioner switch turned on, the controller C controls the electric current supplied to the solenoid 34 based on the difference between a target temperature set by the room temperature setting device 53 and a temperature detected by the room temperature detector 54. As the duty ratio is increased, the opening degree of the valve hole 41 is decreased.

With the valve hole 41 opened, part of the refrigerant gas in the discharge chamber 132 flows into the pressure control chamber 121 through a supply passage 68 including the passage 43, the valve chamber 42, the valve hole 41 and the passage 44. With the valve hole 41 closed, no refrigerant gas in the discharge chamber 132 flows into the pressure control chamber 121 through the supply passage 68.

The pressure control chamber 121 Is in communication with the suction chamber 131 through a bleed passage 69 that is formed in the cylinder block 11, the valve forming plate 15, the valve plate 14, the valve forming plate 16 and the retainer forming plate 17 as show in FIG. 1A. Thus, the refrigerant gas in the pressure control chamber 121 can flow out thereof into the suction chamber 131 through the bleed passage 69. The pressure in the pressure control chamber 121 is varied or-adjusted by controlling the flow of refrigerant gas flowing from the discharge chamber 132 into the pressure control chamber 121 through the supply passage 68 and the flow of refrigerant gas flowing from the pressure control chamber 121 into the suction chamber 131 through the bleed passage 69.

As shown in FIG. 2, the pressure reducing valve 33 has a housing 55 In which a pressure chamber 56 is defined for accommodating therein a bellows 57 as a second displacement body. The pressure chamber 56 communicates with the suction chamber 131 through a passage 58 that is formed in the rear housing 13 as shown in FIG. 1A. The pressure reducing valve 33 also has a valve housing 59 formed with a valve seat 60. The valve seat 60 has formed therein a valve hole 61 as a second valve hole. The valve housing 59 defines therein an accommodation chamber 65 that accommodates therein a valve body 62 as a second valve body and a spring 63. The valve body 62 is operable to open and close the valve hole 61, and the spring 63 functions to urge the valve body 62 in the direction which causes the valve hole 61 to be closed.

A displacement transmitting rod 64 is connected to the bellows 57. The displacement transmitting rod 64 extends through the valve hole 61 and is in contact with the valve body 62. The bellows 57 generates an extension force in such a way that it stretches. This extension force acts against the pressure in the pressure chamber 56. The pressure reducing valve 33 is adapted to open the valve hole 61 when the pressure in the pressure chamber 56 (or the pressure in a suction pressure region) becomes equal to or less than a predetermined standard pressure $P_0$. The standard pressure $P_0$ is appropriately determined in views of the case where the entire amount of the refrigerant gas in the compressor 10 becomes less than the required entire amount of the refrigerant gas and the case where the variable displacement compressor 10 operates at high rotation speed with the valve hole 41 closed For example, the standard pressure $P_0$ is determined as the lowest suction pressure that provides reliable operation of the variable displacement compressor 10.

The valve hole 61 communicates with the pressure chamber 56, and the accommodation chamber 65 communicates with the valve hole 61. The accommodation chamber 65 also communicates with the pressure introducing passage 50B through a passage 66 that is formed in the rear housing 13 as shown in FIG. 1A. In the pressure introducing passage 50B, a throttle 67 is disposed upstream of where the passage 66 and the pressure introducing passage 50B are connected to each other.

In FIG. 2, the valve hole 41 of the displacement control valve 32 is opened, so that part of the refrigerant gas in the discharge chamber 132 flows into the pressure control chamber 121 through the supply passage 68. The refrigerant gas in the pressure control chamber 121 flows out into the suction chamber 132 through the bleed passage 69. However, the pressure in the pressure control chamber 121 is high in the state where the valve hole 41 is opened, so that the inclination angle of the swash plate 22 decreases from the maximum inclination angle.

With the valve hole 41 of the displacement control valve 32 closed, no refrigerant gas in the discharge chamber 132 flows into the pressure control chamber 121 through the supply passage 68. Since the refrigerant gas in the pressure control chamber 121 flows out into the suction chamber 131 through the bleed passage 69, the pressure in the pressure control chamber 121 is low in the state where the valve hole 41 is closed, so that the swash plate 22 is tilted to its maximum angle position and the piston 14 is moved for its maximum length of stroke, accordingly, with the result that the displacement of the compressor 10 becomes the maximum.

If the variable displacement compressor 10 continuously operates at high rotation speed in the state where the valve hole 41 is closed, the pressure of the refrigerant gas that has passed through the evaporator 31 (the pressure in a suction pressure region) falls. Thus, the pressure in the pressure chamber 56 of the pressure reducing valve 33 falls. In accordance with this pressure fall, the bellows 57 generates a greater extension force to stretch. When the pressure in the suction pressure region becomes equal to or less than the predetermined standard pressure $P_0$, the bellows 57 stretches to move the valve body 62 thereby to open the valve hole 61 of the pressure reducing valve 33. With the valve hole 61 opened, the second pressure sensing chamber 46 comes into communication with the suction chamber 131 through the pressure introducing passage 50B, the passage 66, the accommodation chamber 65, the valve hole 61, the pressure chamber 56 and the passage 58. The pressure introducing passage 50B, the passage 66, the accommodation chamber 65, the valve hole 61, the pressure chamber 56 and the passage 58 constitute a pressure reducing passage 70 that constitutes a pressure reducing means in cooperation with the pressure reducing valve 33.

With the second pressure introducing chamber 46 in communication with the suction chamber 131 through the pressure reducing passage 70, the pressure in the second pressure sensing chamber 46 decreases, so that the pressure difference between the first pressure sensing chamber 45 and the second pressure sensing chamber 46 increases. This increases in the pressure difference causes the valve body 381 to move away from the valve hole 41 to open the valve hole 41. The refrigerant gas in the discharge chamber 132 flows into the pressure control chamber 121 through the supply passage 68. As a result, the inclination angle of the swash plate 22 is changed to the minimum, thereby avoiding the large displacement operation of the variable displacement compressor 10 at high rotation speed.

If the refrigerant gas is insufficient in the variable displacement compressor 10, it causes the pressure in the suction pressure region to fall, so that the pressure in the suction pressure region becomes equal to or less than the predetermined standard pressure $P_0$. Then, the valve hole 61 of the pressure reducing valve 33 is opened, so that the second pressure sensing chamber 46 of the displacement control valve 32 is reduced, thus opening the valve hole 41. As a result, the inclination angle of the swash plate 22 is changed to the minimum, thereby avoiding the large displacement operation of the variable displacement compressor 10 with insufficient refrigerant gas.

The pressure reducing means that includes the pressure reducing valve 33 operable to open and close the pressure reducing passage 70 and the pressure reducing passage 70 functions as a pressure-difference-increasing means to increase the pressure difference between the sensed pressure of the first point (or the external refrigerant circuit 28A) and the sensed pressure of the second point (or the external refrigerant circuit 28B) when the pressure in the suction chamber 131 becomes equal to or less than the predetermined standard pressure $P_0$.

The following advantageous effects are obtained according to the first preferred embodiment.

(1-1) When the pressure in the suction chamber 131 (or the suction pressure region) becomes equal to or less than the predetermined standard pressure $P_0$, the valve hole 61 of the pressure reducing valve 33 is opened. The opening degree of the valve hole 41 of the displacement control valve 32 increases, so that an amount of the refrigerant gas flowing from the discharge chamber 132 (or the discharge pressure region) into the pressure control chamber 121 increases Thus, the pressure in the pressure control chamber 121 rises to decrease the displacement of the variable displacement compressor 10, thereby avoiding the large displacement operation of the variable displacement compressor 10 with insufficient refrigerant gas and at high rotation speed is avoided.

(1-2) When the pressure in the suction chamber 131 (or the suction pressure region) becomes equal to or less than the predetermined standard pressure $P_0$, the pressure in the second pressure sensing chamber 46 (the sensed pressure of the second point or the external refrigerant circuit 28B) is released to the suction chamber 131 and reduced. The pressure in the suction pressure region is the lowest pressure in the refrigerant circuit when the variable displacement compressor 10 operates Thus, the suction pressure region is appropriate as the space to which the pressure is released in that the pressure in the second pressure sensing chamber 46 is rapidly reduced.

(1-3) The second pressure sensing chamber 46 is a pressure region on a low pressure side in which the pressure is equal to or smaller than that in first pressure sensing chamber 45. As the pressure of the low pressure side (or the pressure in the second pressure sensing chamber 46) is decreased, the pressure difference between the first pressure sensing chamber 45 and the second pressure sensing chamber 46 increases The structure in which the pressure of the low pressure side is decreased to increase the above pressure difference is advantageous in that the opening degree of the valve hole 41 of the displacement control valve 32 is rapidly increased.

(1-4) As the amount of the refrigerant gas flowing from the external refrigerant circuit 28B (or the discharge pressure region) through the pressure reducing passage 70 into the suction chamber 131 (or the suction pressure region) increases, operating efficiency of the variable displacement compressor 10 deteriorates. However, the throttle 67 is provided in the pressure introducing passage 50*b* that introduces the pressure in the second point or the external refrigerant circuit 28B into the second pressure sensing chamber 46. The provision of the throttle 67 in the pressure introducing passage 50B is advantageous in that the refrigerant gas is prevented from wastefully flowing from the external refrigerant circuit 28B to the suction chamber 131 through the pressure reducing passage 70.

(1-5) The paired projections 221 and 222 on the swash plate 22 are inserted between the paired arms 212 and 213 on the lug plate 21, and the hinge mechanism 77 allows the swash plate 22 to freely move in the axial direction of the-rotary shaft 18. Thus, if the variable displacement compressor 10 using the hinge mechanism 77 operates at its large displacement and at high rotation speed with insufficient refrigerant gas, the inclination angle of the swash plate 22 at the maximum displacement operation may exceed the predetermined maximum inclination angle. The present invention that provides the pressure reducing means (or the pressure-difference-increasing means) is suitable for the variable displacement compressor 10 including the hinge mechanism 77.

Figure 3:
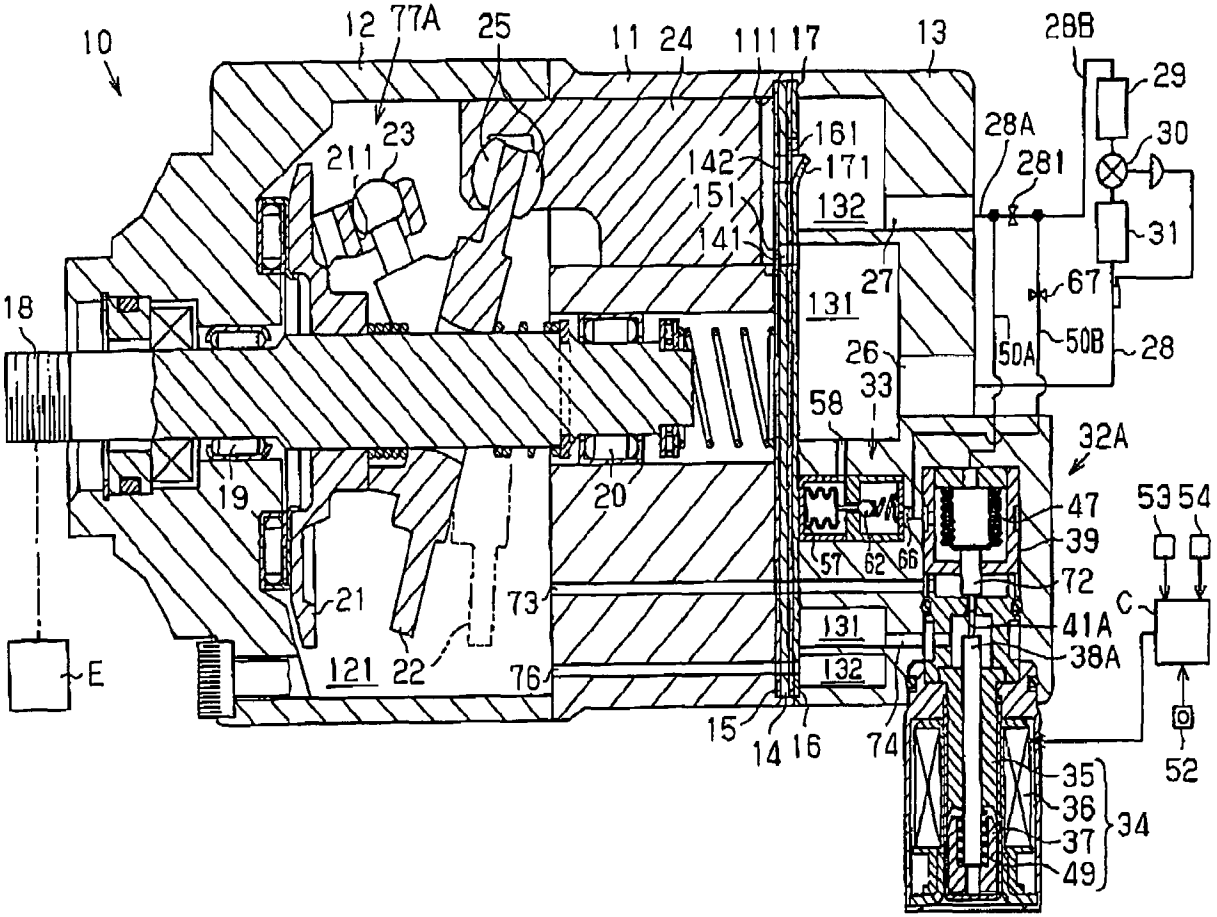
FIG. 3 is a longitudinal cross-sectional view of a variable displacement compressor of a second preferred embodiment according to the present invention.
Figure 4:
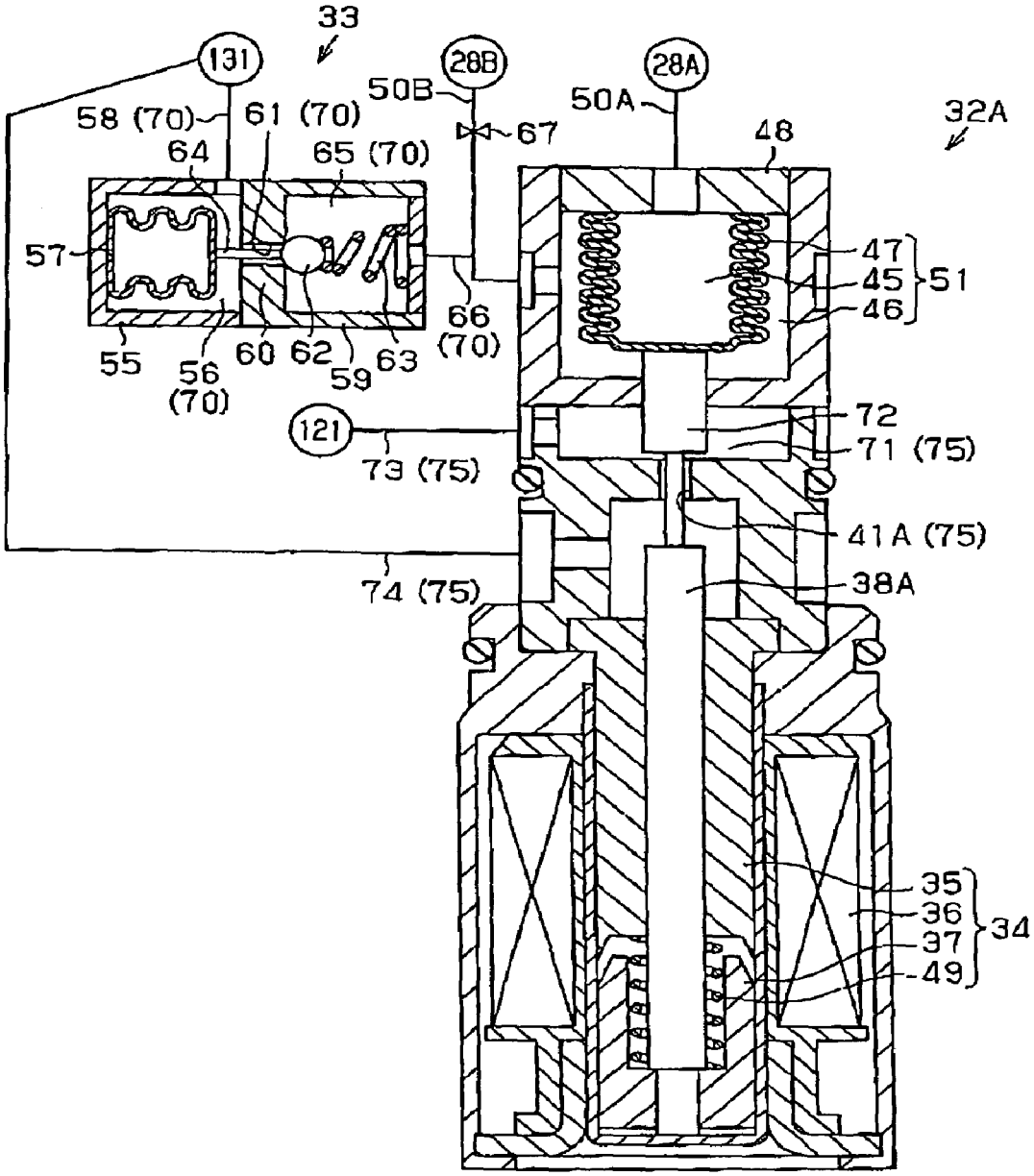
FIG. 4 is a cross-sectional view of a pressure reducing valve and a displacement control valve of the second preferred embodiment.

The following will describe a second preferred embodiment with reference to FIGS. 3 and 4. Like numerals are referred to as like or same parts or elements as those in the first preferred embodiment. Referring to FIG. 3, the lug plate 21 has formed therein a pair of guide holes 211. A pair of guide pins 23 are provided on the swash plate 22 and slidably fitted in the paired guide holes 211, respectively. The guide holes 211 and the guide pins 23 cooperate to allow the swash plate 22 to incline relative to the axial direction of the rotary shaft 18 and rotate integrally with the rotary shaft 18. The inclination of the swash plate 22 is guided with the guide pins 23 respectively sliding on the guide holes 211 and the swash plate 22 sliding on the rotary shaft 18. The guide holes 211 and the guide pins 23 constitute a hinge mechanism 77A that connects the swash plate 22 to the lug plate 21 for allowing the swash plate 22 to incline relative to the lug plate 21 and transmitting the rotation of the rotary shaft 18 to the swash plate 22.

Referring to FIG. 4, the valve hole 41A of a displacement control valve 32A communicates with a valve chamber 71 that accommodates therein a valve body 72. The valve body 72 is connected to the bellows 47. A transmitting rod 38A is connected to the valve body 72. The valve body 72 is movable in conjunction with the transmitting rod 38A.

The valve chamber 71 communicates with the pressure control chamber 121 through a passage 73 that is formed in the cylinder block 11, the valve forming plate 15, the valve plate 14, the valve forming plate 16, the retainer forming plate 17 and the rear housing 13 as shown in FIG. 3. The valve hole 41A communicates with the suction chamber 131 through a passage 74 that is formed in the rear housing 13 as shown in FIG. 3. The passage 73, the valve chamber 71, the valve hole 41A and the passage 74 constitute a bleed passage 75 for releasing the refrigerant gas in the pressure control chamber 121 into the suction chamber 131. The discharge chamber 132 communicates with the pressure control chamber 121 through a supply passage 76 that is formed in the cylinder block 11, the valve forming plate 15, the valve plate 14, the valve forming plate 16 and the retainer forming plate 17 as shown in FIG. 3.

The controller C controls the electric current supplied to the solenoid 34 based on the difference between a target temperature set by the room temperature setting device 53 and a temperature detected by the room temperature detector 54. As the duty ratio is increased, the opening degree of the valve hole 41 is increased.

In FIG. 4, the valve hole 41A of the displacement control valve 32A is opened, so that part of the refrigerant gas in the pressure control chamber 121 flows out into the suction chamber 131 through the bleed passage 75. The refrigerant gas in the discharge chamber 132 flows into the pressure control chamber 121 through the supply passage 76. However, the pressure in the pressure control chamber 121 is low in the state where the valve hole 41A is opened, so that the swash plate 22 is tilted to its maximum angle position. In this state, the piston 14 is moved for its maximum length of stroke, accordingly, with the result that the displacement of the compressor 10 becomes the maximum.

With the valve hole 41A closed, no refrigerant gas in the pressure control chamber 121 flow out into the suction chamber 131 through the bleed passage 75. Since the refrigerant gas in the discharge chamber 132 flows into the pressure control chamber 121 through the supply passage 76, the pressure in the pressure control chamber 121 is high in the state where the valve hole 41A is closed. Thus, the inclination angle of the swash plate 22 becomes the minimum.

When the pressure in the suction chamber 131 becomes equal to or less than the predetermined standard pressure $P_0$, the pressure difference between the first pressure sensing chamber 45 and the second pressure sensing chamber 46 increases and the valve hole 41A is closed. As a result, the inclination angle of the swash plate 22 decreases, thereby avoiding the large displacement operation of the variable displacement compressor 10 at high rotation speed and with insufficient refrigerant gas.

According to the present invention, the following alternative embodiments are practicable.

(1) The pressure reducing means may be so constructed that the pressure chamber 56 of the pressure reducing valve 33 may communicate with the pressure control chamber 121, so that the refrigerant gas in the first pressure sensing chamber 45 is released to the pressure control chamber 121 when the valve hole 61 is opened (2) The second pressure sensing chamber 46 may communicate with either the suction pressure 131 or the external refrigerant circuit 28B according to the magnitude relation between the pressure in the suction chamber 131 and the predetermined standard pressure $P_0$. More specifically, the pressure-difference-increasing means may be constructed so that the second pressure sensing chamber 46 communicates with the external refrigerant circuit 28B when the pressure in the suction chamber 131 is larger than the standard pressure $P_0$ and so that the second pressure sensing chamber 46 communicates with the suction chamber 131 when the pressure in the suction chamber 131 is equal to or less than the standard pressure $P_0$.

(3) A pressure sensing means including a diaphragm as a displacement body may be used.

(4) A pressure sensing means including a piston type movable wall as a displacement body, which is disclosed in Unexamined Japanese Patent Publication No. 2001-153044, may be used.

(5) A pressure reducing means in which the pressure chamber is divided by a diaphragm instead of the bellows may be used.

(6) A pressure reducing means in which the pressure chamber is divided by a piston type movable wall instead of the bellows may be used.

(7) In the first preferred embodiment, a pair of arms may be provided on the swash plate 22 and a pair of projections may be provided on the lug plate 21.

The present examples and embodiments are to be considered as illustrative and not restrictive, and the invention is not to be limited to the details given herein but may be modified within the scope of the appended claims.

What is claimed is:

1. A displacement control mechanism used for a variable displacement compressor that adjusts a pressure in a pressure control chamber by introducing a refrigerant in a discharge pressure region into the pressure control chamber through a supply passage and releasing the refrigerant in the pressure control chamber to a suction pressure region through a bleed passage, thereby controlling displacement of the compressor, the displacement control mechanism comprising:

a first valve hole partially forming the supply passage or the bleed passage;

a first valve body operable to open and close the first valve hole;

a pressure sensing means operable to sense a pressure of a first point in the discharge pressure region and a pressure of a second point in the discharge pressure region and to adjust a position of the first valve body based on pressure difference between the first and second points; and a pressure reducing means operable to increase the pressure difference between the first and second points when the pressure of the suction pressure region falls below a predetermined standard pressure, wherein the pressure sensing means displaces the first valve body in such a direction so as to increase an opening degree of the first valve hole according to increase of the pressure difference when the first valve hole is a part of the supply passage, wherein the pressure sensing means displaces the first valve body in such a direction so as to decrease the opening degree of the first valve hole according to the increase of the pressure difference when the first valve hole is a part of the bleed passage, wherein the pressure reducing means further has a pressure reducing valve operable to reduce a pressure of a low pressure side out of the sensed pressures of the first and second point thereby to increase the pressure difference between the first and second points, and wherein the pressure reducing valve is opened when the pressure of the suction pressure falls below the predetermined standard pressure.

2. The displacement control mechanism according to claim 1, wherein the pressure reducing means releases the pressure of the low pressure side out of the sensed pressures of the first and second points to the suction pressure region thereby to reduce the pressure of the low pressure side.

3. The displacement control mechanism according to claim 1, wherein the pressure sensing means includes a first pressure sensing chamber, a second pressure sensing chamber and a first displacement body that divides the first and second pressure sensing chambers, wherein the first valve body is connected to the first displacement body, wherein the pressure of the first point is introduced into the first pressure sensing chamber, and wherein the pressure of the second point is introduced into the second pressure sensing chamber.

4. The displacement control mechanism according to claim 3, wherein the first displacement body is a bellows stretchable according to the increase of the pressure difference between the first and second points.

5. The displacement control mechanism according to claim 3, wherein the second pressure sensing chamber is a pressure region on the low pressure side in which the pressure is smaller than that in the first pressure sensing chamber, wherein a throttle is provided in a pressure introducing passage that introduces the pressure in the second point into the second pressure sensing chamber, wherein the pressure reducing means includes a pressure reducing passage connected to the pressure introducing passage on a downstream side of the throttle, and wherein the pressure in the second pressure sensing chamber is released to the suction pressure region via the pressure reducing passage.

6. The displacement control mechanism according to claim 5, wherein the pressure reducing passage is communicable with the suction pressure region, and wherein the pressure reducing valve is operable to open and close the pressure reducing passage.

7. The displacement control mechanism according to claim 6, wherein the pressure reducing passage includes a second valve hole, wherein the pressure reducing valve includes a second valve body operable to open and close the second valve hole and a second displacement body connected to the second valve body, and wherein the second displacement body operable to move the second valve body thereby to open the second valve hole when the pressure in the suction pressure region becomes equal to or less than the predetermined standard pressure.

8. The displacement control mechanism according to claim 7, wherein the second displacement body is a bellows that stretches when the pressure in the suction pressure region becomes equal to or less than the predetermined standard pressure.

9. The displacement control mechanism according to claim 1, wherein the variable displacement compressor includes:

a rotary shaft;

a lug plate secured to the rotary shaft;

a swash plate supported by the rotary shaft so as to be slidable along and inclinable relative to an axis of the rotary shaft; and a hinge mechanism provided between the swash plate and the lug plate and connecting the swash plate to the lug plate for allowing the swash plate to incline relative to the axis of the rotary shaft and transmitting rotation of the rotary shaft to the swash plate, wherein the hinge mechanism includes a projection extending from one of the lug plate and the swash plate and plural arms extending from the other, and wherein the projection is inserted in a recess formed by the plural arms.

10. The displacement control mechanism according to claim 1, wherein the position of the first valve body is adjusted by an urging force of the pressure sensing means and an electromagnetic force of a solenoid that acts against the urging force of the pressure sensing means.

* * * * *

UNITED STATES PATENT AND TRADEMARK OFFICE

CERTIFICATE OF CORRECTION

PATENT NO. : 7,559,208 B2
APPLICATION NO. : 11/243266
DATED : July 14, 2009
INVENTOR(S) : Ota et al.

It is certified that error appears in the above-identified patent and that said Letters Patent is hereby corrected as shown below:

In claim 1, col. 11, lines 47-48, please delete "first and second point" and insert therefore -- first and second points --.

Signed and Sealed this

Tenth Day of November, 2009

David J. Kappos

David J. Kappos
*Director of the United States Patent and Trademark Office*